US006434859B1

(12) United States Patent
Kim

(10) Patent No.: US 6,434,859 B1
(45) **Date of Patent: *Aug. 20, 2002**

(54) INSOLE FOR SHOES DESIGNED TO INCREASE A THERAPEUTIC EFFECT BASED ON REFLEX ZONE THERAPY

(76) Inventor: Joo Tae Kim, 518, Yangjang-ri, Kunseo-myeon, Yongam-gun, Chollanam-do 526-850 (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/408,509

(22) Filed: Sep. 30, 1999

(51) Int. Cl.[7] ..... A43B 13/38

(52) U.S. Cl. ..... 36/43; 36/44; 36/141; 36/3 B

(58) Field of Search ..... 36/43, 44, 141, 36/3 B, 155, 100, 160

(56) References Cited

U.S. PATENT DOCUMENTS

| | | | | | |
|---|---|---|---|---|---|
| 682,141 | A | * | 9/1901 | Galloway | 36/3 B |
| 825,515 | A | * | 7/1906 | Byrne et al. | 36/3 B |
| 1,128,220 | A | * | 2/1915 | Bullard | 36/3 B |
| 2,018,233 | A | * | 10/1935 | Smith, Jr. | 36/160 |
| 2,307,416 | A | * | 1/1943 | Margolin | 36/43 |
| 4,760,654 | A | * | 8/1988 | Limbach | 36/117.5 |
| 5,493,791 | A | * | 2/1996 | Kramer | 36/3 B |
| 6,000,147 | A | * | 12/1999 | Kellerman | 36/160 |

FOREIGN PATENT DOCUMENTS

| | | | | |
|---|---|---|---|---|
| DE | 474016 | * | 3/1929 | 36/3 B |
| DE | 3330060 | * | 2/1985 | 36/43 |
| GB | 2136268 A | * | 9/1984 | 36/160 |

* cited by examiner

*Primary Examiner*—Mickey Yu
*Assistant Examiner*—Troy Arnold
(74) *Attorney, Agent, or Firm*—Birch, Stewart, Kolasch & Birch, LLP

(57) ABSTRACT

An insole for shoes having a plurality of protrusions, each of the protrusions having a ventilation hole formed through its center. A protrusion is connected with a thin support portion protruding from the insole and having a downwardly increasing diameter, so that the protrusions are integrally molded with the insole. The support portions can have a frustoconical shape. In order to prevent the insole from being easily deviated from the shoe, a pad having double-faced tape and a plurality of lugs is provided.

21 Claims, 4 Drawing Sheets

INSOLE FOR SHOES DESIGNED TO INCREASE A THERAPEUTIC EFFECT BASED ON REFLEX ZONE THERAPY

FIELD OF THE INVENTION

The present invention relates to an insole for shoes; and, more particularly, to an insole for shoes having a ventilating hole allowing a foot-sole to be ventilated therethrough, and providing therapeutic effect based on reflex zone therapy as well as a massage effect.

DESCRIPTION OF THE PRIOR ART

A term "reflex zone therapy" describes a treatment based on the established fact that special zones of the soles and palms are correlated to certain internal organs. A therapist can diagnose certain diseases of these organs by applying pressure on the corresponding reflex zones of the sole, which will cause the patient a more or less intensive sensation of pain. On the other hand, the therapist can achieve an intensive stimulation of the corresponding organ by carefully massaging these special zones.

In this season, a plurality of insoles for shoes having a therapeutic effect based on the reflex zone therapy have been proposed. These insoles for shoes also can prevent a moisture generation which may occur from a contact between a foot-sole and the insole.

Especially, in order to maximize ventilation capability in the shoe, even a configuration where an outside air is forced to be introduced into the shoe by a pumping action provided in an outsole of the shoe has been proposed, which has a shortcoming of an increased manufacturing cost.

To overcome the shortcoming, Korean Utility Model Publication No. 1992-7619 discloses an insole for shoes having a therapeutic effect based on the reflex zone therapy and an increased ventilation capability. In the prior art, the insole has ceramic powder integrally mixed and molded therewith, an annular groove formed on its upper surface, and a plurality of reflex zone protrusions protruding from the upper surface each of which has a ventilation hole and a hollow portion. The insole also has a plurality of arcuate protrusions each of which is formed on an lower surface of the insole, corresponding to positions of the reflex zone protrusions and has an air passage communicating with the ventilation hole.

The prior art described above, however, has shortcomings. First, when the reflex zone protrusion is pressurized by the foot, it is easily laid flat. As a result, it cannot provide an appropriate massage onto the reflex zones of the foot-sole. Secondly, the reflex zone protrusion which has been collapsed is not properly restored to its original shape in the prior art.

SUMMARY OF THE INVENTION

It is, therefore, a primary object of the invention to provide an insole for shoes having a maximized therapeutic effect based on the reflex zone therapy as well as an enhanced ventilation capability.

Another object of the present invention is to provide an insole for shoes having a plurality of protrusions, the insole characterized in that each of the protrusions is made of silicone and has a ventilation hole formed through a center of the protrusion, the protrusion being connected with a thin slanted portion protruding from the insole and having a diameter larger along a downward direction of the thin slanted portion, so that the protrusions are integrally molded with the insole.

As one aspect of the present invention, a plurality of lug holes are formed through the insole; and the insole further comprises a pad having on its lower portion a double-faced tape attached to both the pad and an upper surface of the shoe, and a plurality of lugs protruding from an upper surface of the pad, the lugs positioned to correspond to the lug holes, respectively and insertable into the lug holes.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

A first preferred embodiment of an inventive insole for shoes is now described with reference to FIGS. 1 through 5.

Figure 1:
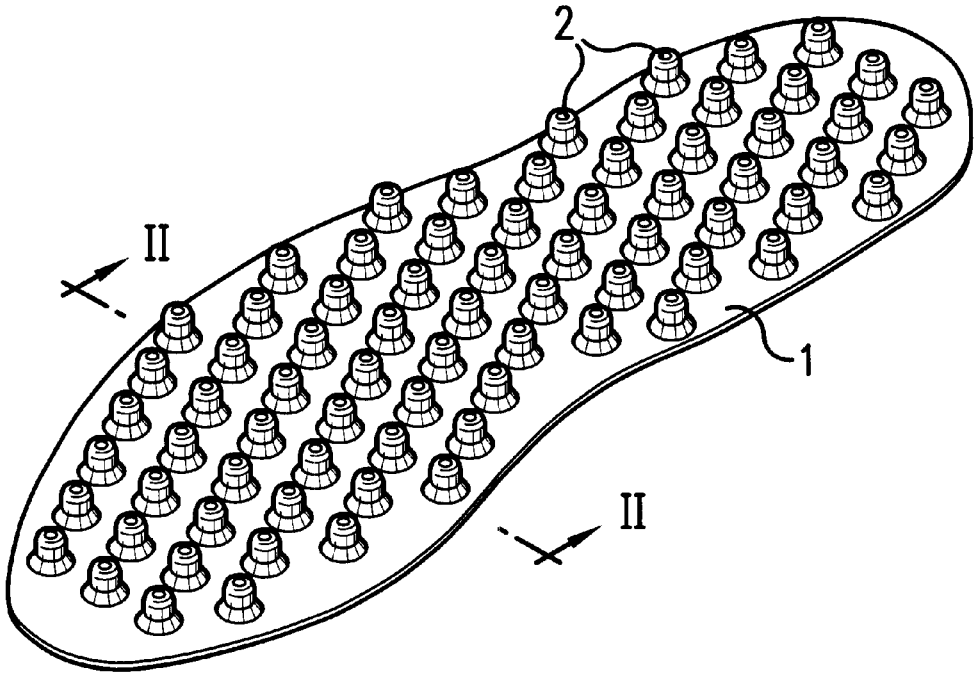
FIG. 1 illustrates a perspective view of a first embodiment of the inventive insole.
Figure 2:
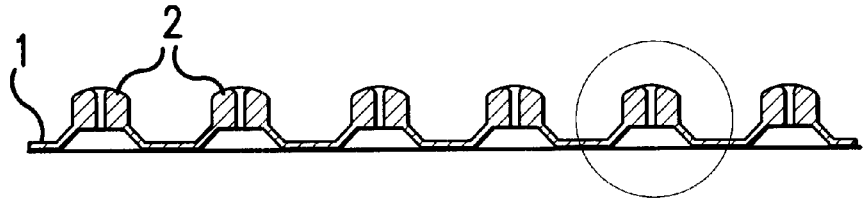
FIG. 2 shows a sectional view of the inventive insole shown in FIG. 1, when taken along the line ll—ll.

FIG. 1 illustrates a perspective view of the first embodiment of the inventive insole; FIG. 2 shows a sectional view of the inventive insole shown in FIG. 1, when taken along the line ll—11; and FIG. 3 depicts a partial enlarged view of a reflex one knob of the inventive insole shown in FIG. 2.

Figure 3:
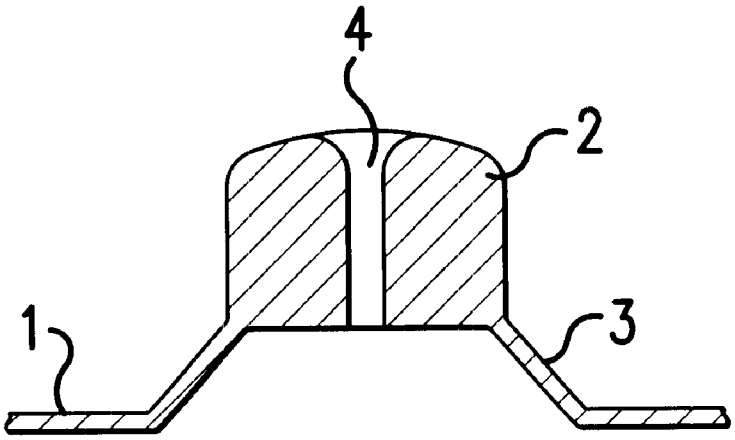
FIG. 3 depicts a partial enlarged view of a reflex zone knob of the inventive insole shown in FIG. 2.

Referring to FIGS. 1 through 3, the inventive insoles for shoes 1 made of silicone has a reflex zone knobs 2 protruding from its upper surface of the insole.

The reflex zone knob 2 is for a therapeutic effect based on the reflex zone therapy described in the section of "Description of the prior art".

Although the knob 2 is shown as a cylindrical shape, a variety of shapes, e.g., a post having a polygonal shape, e.g., a rectangular shape or a hexagonal shape, are allowable. The knob 2 has a ventilation hole 4 vertically formed through a center of the knob 2, through which the ventilation occurs and an air occupied in a lower side of the knob is exhausted, when the knob 2 is collapsed.

The knob 2 is connected with a slanted portion 3 made of a thin and soft material, thereby being integrally molded with the insole 1. The slanted portion 3 protrudes from the upper surface of the insole 1 and has a diameter larger along its downward direction.

Figure 4:
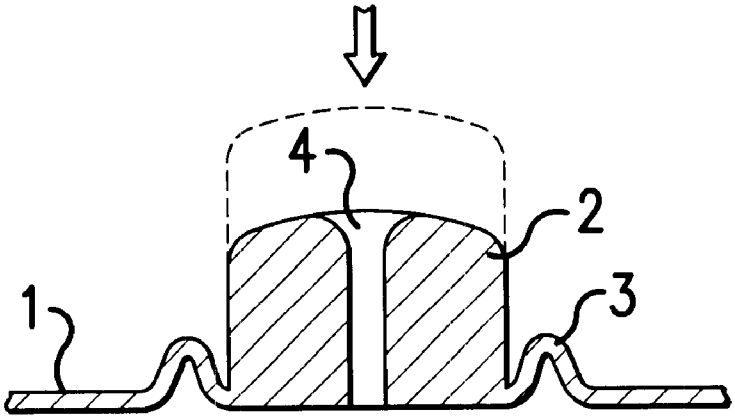
FIG. 4 presents a sectional view of the reflex zone knob showing its vertical movement.
Figure 5:
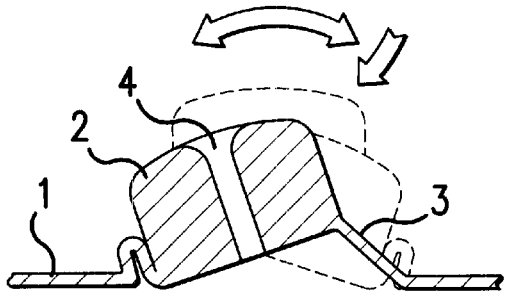
FIG. 5 represents a section view of the reflex zone knob showing its tilting movement.

FIG. 4 presents a sectional view of the reflex zone knob showing its vertical movement; and FIG. 5 represents a section view of the reflex zone knob showing its tilting movement.

Referring to FIGS. 4 and 5, when the knob 2 is pressurized by the foot, the slanted portion 3 is freely folded in any direction. Even at this time, the knob 2 is maintained in a position protruding above the upper surface of the insole 1, continuously massaging the reflex zone of the foot-sole.

Further, the slanted portion 3 is tiltable when a force laterally exerted by the foot-sole is applied on the knob 2, since it is made of thin and soft material. In this case, the therapeutic effect based on the reflex zone therapy together with the massage effect is still obtained regardless of the direction of the force.

A second preferred embodiment of an inventive insole for shoes is now described with reference to FIGS. 6 and 7.

Figure 6:
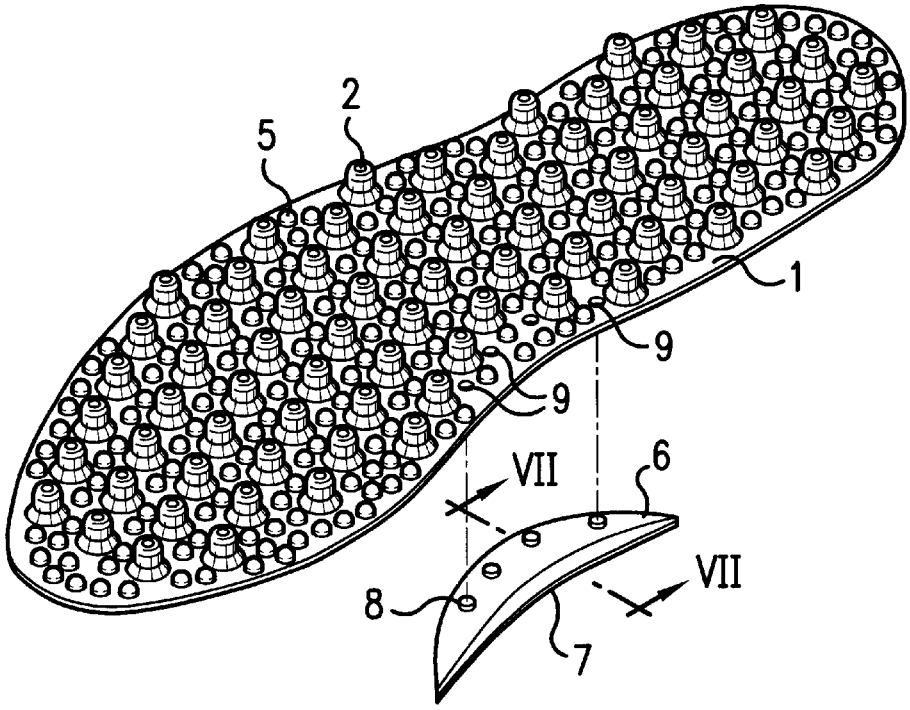
FIG. 6 describes a perspective view of a second embodiment of the inventive insole.
Figure 7:
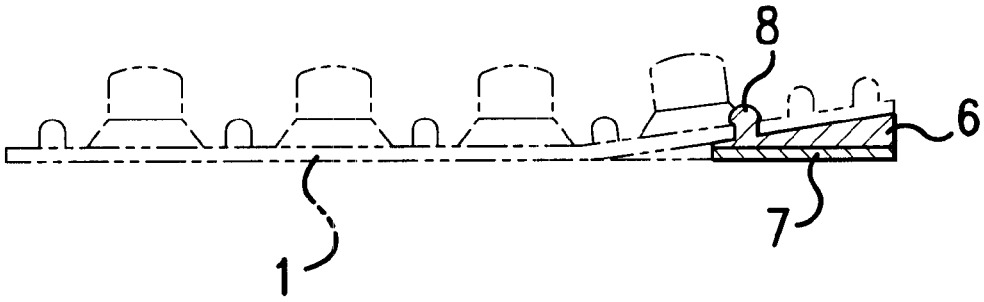
FIG. 7 discloses a sectional view of the inventive insole shown in FIG. 6, when taken along the live VII—VII.

FIG. 6 describes a perspective view of a second embodiment of the inventive insole; and FIG. 7 discloses a sectional view of the inventive insole shown in FIG. 6, when taken along the line VII—VII.

Referring to FIGS. 6 and 7, in order to prevent the insole 1 from being easily deviated from the shoe(not shown), a pad 6 is provided. The pad 6 has on its bottom portion a double-faced tape 7 which is attached to both the pad 6 and an upper surface of the shoe. The pad 6 also has on its upper portion a plurality of lugs 8 protruding from the pad 6. In order to fix the pad 6 to the insole 1, the insole 1 has a plurality of lug holes 9 corresponding to the plurality of lugs 8 on the pad 6, respectively. Each of the lugs 8 is inserted into each of the lug hole 9.

The insole 1 is fixed with respect to the shoe in such a manner that the pad 6 is first attached to the upper surface of the shoe and then the lugs 8 on the pad 6 are inserted into the lug holes 9, respectively.

In the inventive insole 1, since the knob 2 can be tilted, maintaining the therapeutic effect based on the reflex zone therapy and the massage effect onto the foot-sole, in every direction to such a degree that the slanted portion 3 can be folded, the knob 2 provides the user with a good feeling, when being touched with the user's foot-sole. Further, the inventive insole 1 allows the user to feel comfortable, since the knob 2 is made of silicone and has a resilience.

The inventive insole 1, wherein the reflex zone knob 2 made of silicone and having the ventilation hole 4 formed through the center of the knob is connected with the slanted portion 3 protruding from the upper surface of the insole and having the diameter larger along its downward direction, thereby being integrally molded with the insole 1, can maintain a continuous therapeutic effect based on the reflex zone therapy, since the knob 2 protrudes above the upper surface of the insole 1, even if the knob 2 is collapsed. Further, since the inventive insole 1 can be tilted, it provides the user with a good feeling. Furthermore, the inventive insole 1 provides the massage effect of the foot-sole.

Although the invention has been shown and described with respect to the preferred embodiments, it will be understood by those skilled in the art that various changes and modifications may be made without departing from the spirit and scope of the invention as defined in the following claims.

What is claimed is:

1. An insole for footwear comprising:

a base portion;

a plurality of protrusions, each of said protrusions having a wall; and a plurality of support portions for supporting the protrusions at an upper surface of the base portion, each support portion supporting one of said protrusions, the support portion being connected at a first end to the base portion, and at a second end to one of said protrusions, the support portion having a cross-sectional area decreasing from its first end to its second end, wherein each of said plurality of support portions has a wall having a thickness less than a thickness of said wall of a respective one of said plurality of protrusions.

2. The insole of claim 1, wherein the support portions have a substantially frustoconical shape.

3. The insole of claim 2, wherein the protrusions are substantially cylindrical in shape.

4. The insole of claim 3, wherein each protrusion includes a ventilation hole axially extending through the protrusion.

5. The insole of claim 4, wherein each protrusion is integrally formed with its respective support portion.

6. The insole of claim 4, wherein the support portions are integrally formed with the base portion.

7. The insole of claim 1, wherein the protrusions are made from silicone.

8. The insole of claim 1, wherein the support portions have a substantially frustoconical shape.

9. The insole of claim 8, wherein the protrusions are substantially cylindrical in shape, each protrusion including a ventilation hole axially extending through the protrusion.

10. The insole of claim 1, wherein the protrusions, the support portions, and the base portion comprise an integrally molded, silicon article.

11. The insole of claim 1, wherein each support portion is open at its first end, and at its second end opens into a ventilation hole extending through its corresponding protrusion.

12. The insole of claim 1, further comprising a pad that is attachable to a lower surface of the base portion, the pad including a plurality of lugs extending from an upper surface of the pad, the lugs being insertable into a plurality of lug holes provided in the base portion.

13. An insole for footwear comprising:

a base portion;

a plurality of protrusions, each of said protrusions having a wall; and a plurality of flexible support portions for supporting the protrusions at an upper surface of the base portion, each support portion supporting one of said protrusions at a distance above the upper surface of the base portion, each of said support portions being connected at a first end to the base portion, and at a second end to one of said protrusions, wherein each of said plurality of support portions has a wall having a thickness less than a thickness of said wall of a respective one of said plurality of protrusions.

14. The insole of claim 13, wherein each support portion is open at its first end, and open at its second end into a ventilation hole extending through its corresponding protrusion.

15. The insole of claim 13, wherein the support portions have a substantially frustoconical shape, and the protrusions are substantially cylindrical in shape.

16. The insole of claim 13, further comprising a pad that is attachable to a lower surface of the base portion, the pad including a plurality of lugs extending from an upper surface of the pad, the lugs being insertable into a plurality of lug holes provided in the base portion.

17. The insole of claim 12, wherein the pad includes double-sided tape on a lower surface of the pad.

18. The insole of claim 13, wherein the protrusions, the support portions, and the base portion comprise an integrally molded, silicone element.

19. An insole for footwear comprising:

a base portion;

a plurality of protrusions, each of said protrusions having a wall; and a plurality of support portions for supporting the protrusions above an upper surface of the base portion, each of said support portions having a construction with a thinner wall than a wall of a respective one of said protrusions, whereby each of the protrusions, as a unit, is vertically displaceable and tiltable relative to the base portion as a result of the construction of the support portions.

20. The insole of claim 19, wherein the support portions contain substantially hollow portions and said protrusions contain a ventilation channel which extends there-through and communicates with said hollow portions.

21. The insole of claim 19, wherein the support portions have a substantially frustoconical shape with its cross-sectional area decreasing from the base member toward the support portions.

* * * * *

UNITED STATES PATENT AND TRADEMARK OFFICE

CERTIFICATE OF CORRECTION

PATENT NO. : 6,434,859 B1
DATED : August 20, 2002
INVENTOR(S) : Joo Tae Kim

It is certified that error appears in the above-identified patent and that said Letters Patent is hereby corrected as shown below:

Title page,
Item [54], please correct the title from "INSOLE FOR SHOES DESIGNED TO INCREASE A THERAPEUTIC EFFECT BASED ON REFLEX ZONE THERAPY" to -- INSOLE FOR SHOES DESIGNED TO PRODUCE A THERAPEUTIC EFFECT BASED ON REFLEX ZONE THERAPY --.

Signed and Sealed this

Eighteenth Day of February, 2003

JAMES E. ROGAN
*Director of the United States Patent and Trademark Office*